US011548543B2

(12) United States Patent
Hammerl et al.

(10) Patent No.: US 11,548,543 B2
(45) Date of Patent: Jan. 10, 2023

(54) LINE SECTION FOR MIXED OPERATION WITH AND WITHOUT A TRAIN PROTECTION SYSTEM, AND OPERATING METHOD

(71) Applicant: SIEMENS MOBILITY GMBH, Munich (DE)

(72) Inventors: Malte Hammerl, Braunschweig (DE); Jacob Johannes Kohlruss, Braunschweig (DE)

(73) Assignee: Siemens Mobility GmbH, Munich (DE)

( * ) Notice: Subject to any disclaimer, the term of this patent is extended or adjusted under 35 U.S.C. 154(b) by 307 days.

(21) Appl. No.: 16/751,286

(22) Filed: Jan. 24, 2020

(65) Prior Publication Data

US 2020/0239051 A1 Jul. 30, 2020

(30) Foreign Application Priority Data

Jan. 24, 2019 (DE) ..... 102019200887

(51) Int. Cl.
*B61L 27/00* (2022.01)
*B61L 27/16* (2022.01)
*B61L 27/40* (2022.01)

(52) U.S. Cl.
CPC ..... *B61L 27/16* (2022.01); *B61L 27/40* (2022.01); *B61L 2205/00* (2013.01)

(58) Field of Classification Search
CPC ..... B61L 27/00; B61L 27/16; B61L 27/40; B61L 2205/00; B61L 2027/204; B61L 23/14
See application file for complete search history.

(56) References Cited

U.S. PATENT DOCUMENTS 4,087,066 A * 5/1978 Bahker ..... B61L 27/20 246/167 R
4,087,067 A * 5/1978 Bahker ..... B61L 27/20 246/167 R
4,491,290 A * 1/1985 Douglas ..... B61L 25/021 250/342
4,742,460 A * 5/1988 Hollands ..... B61L 13/04 701/19
4,774,669 A * 9/1988 Schmitz ..... B61L 15/0081 246/5

(Continued)

FOREIGN PATENT DOCUMENTS

DE 102014223195 A1 5/2016

*Primary Examiner* — Tung S Lau
(74) *Attorney, Agent, or Firm* — Laurence A. Greenberg; Werner H. Stemer; Ralph E. Locher

(57) ABSTRACT

A method performs a mixed operation of a track-bound line section. Trains that are equipped with a train protection system run there. In order to guide trains that are not equipped with the train protection system through the line section, provision is made for switches to be set as a protecting switch for the purpose of following-move protection. However, the switch is reset again before the passage of the unequipped train, wherein the respective block section of the line section must be free again at this time point. The method therefore allows mixed operation of equipped and unequipped trains while at the same time requiring limited component expense for lineside train protection apparatus.

15 Claims, 4 Drawing Sheets

(56) References Cited

U.S. PATENT DOCUMENTS

| | | | | | |
|---|---|---|---|---|---|
| 5,006,847 | A * | 4/1991 | Rush | B61L 27/14 | 340/994 |
| 5,896,017 | A * | 4/1999 | Severson | H02J 13/00009 | 104/276 |
| 6,624,537 | B2 * | 9/2003 | Westlake | A63H 19/24 | 307/140 |
| 7,810,435 | B2 * | 10/2010 | Maier | G05F 1/66 | 105/1.5 |
| 2001/0015578 | A1 * | 8/2001 | Westlake | A63H 19/24 | 307/116 |
| 2007/0241726 | A1 * | 10/2007 | Parisi | G05F 1/66 | 323/234 |
| 2015/0102176 | A1 * | 4/2015 | Tippey | B61L 3/125 | 246/3 |

* cited by examiner

LINE SECTION FOR MIXED OPERATION WITH AND WITHOUT A TRAIN PROTECTION SYSTEM, AND OPERATING METHOD

CROSS-REFERENCE TO RELATED APPLICATION

This application claims the priority, under 35 U.S.C. § 119, of German application DE 10 2019 200 887, filed Jan. 24, 2019; the prior application is herewith incorporated by reference in its entirety.

BACKGROUND OF THE INVENTION

Field of the Invention

The invention relates to a method for the mixed operation of a track-bound line section, wherein this can be traversed by trains that are equipped with a train protection system, in particular CBTC, and by trains that are not equipped with the train protection system, and wherein the line section is fitted with at least one switch. The invention further relates to a track-bound line section, wherein this can be traversed:
a) by trains that are equipped with the train protection system; and
b) by trains that are not equipped with the train protection system, and is fitted with at least one switch.

In large conurbations, old train protection technology and interlocking cabin equipment (i.e. a lineside train protection arrangement) based on conventional track clear indication and signals is increasingly being replaced by modern systems. Using the new train protection systems, a movement authority can be indicated directly in the locomotive cab (and monitored by on-board equipment) by means of wireless transfer. This means that the lineside signals (i.e. the lineside protection apparatus) become superfluous for trains that are equipped with these new train protection systems. It is therefore important in the context of this invention to distinguish between the train protection arrangement which is always installed at lineside, and train protection systems with which trains are equipped, wherein the train protection systems for the respective trains render a train protection arrangement (lineside) superfluous. For example, communication-based train control (CBTC) can be deployed as a train protection system.

In many conurbations, main-line transport passenger trains and long-distance goods trains that are not equipped with the new train protection system operate occasionally in mixed traffic with the local transport trains that are so equipped. The lineside signals on the respective corridors must therefore still be retained for the main-line transport alone, even though they are no longer required for the local transport which operates predominantly there. Signals must be maintained, and the servicing can be very cost-intensive. If the corridor affected by the mixed traffic is quite long and the proportion of main-line transport is relatively low in comparison with local transport, it is not cost-effective to retain the lineside signals.

In order to increase the cost-effectiveness, the lineside signals could be thinned out and very long routes set up, which could extend over several kilometers and up to 50 km. A route of such length would then have the disadvantage that no other rail traffic could operate for a very long time before the passage of the main-line train, since the trackway elements are reserved for the route of the main-line train.

This would in turn restrict the considerably higher frequencies of local transport, which would not be acceptable at peak periods in particular.

BRIEF SUMMARY OF THE INVENTION

The object of the invention is therefore to specify a method for the mixed operation of a track-bound line section (i.e. traversal by trains that are equipped with a train protection system and, using a lineside train protection arrangement, by trains that are not equipped with the train protection system), which method is both cost-effective in respect of the necessary train protection components of the line-bound train protection system, and efficient in respect of the level of utilization of the line section by trains either with or without an installed train protection system. The object of the invention is further to specify a line section by which the cited method can be performed.

This object is inventively achieved by the subject matter of the claim (method) as cited in the introduction, in that in the event that a train that is not equipped with the train protection system is to enter the line section, a block section thereof which extends as far as the switch is authorized, wherein:
a) the switch is set for the purpose of following-move protection; and
b) the switch is reset again before the passage of the train that is not equipped with the train protection system.

The invention therefore relates to a scenario in which long line sections with many sidetrack connection points are available, wherein trains that are not equipped with the train protection system are expected to pass along the line. These trains only pass through the line section which is equipped with the protection system at lineside. Furthermore, signals are preferably no longer provided on the line section, neither for protection nor for block division. Provision is made for dispensing with at least many of the signals. Likewise, track clear indication using axle counters or track circuits is preferably omitted.

In order to allow such a train that is not equipped with the train protection system to pass along the line section without the solution according to the invention, only one technical solution would currently be available: provide a very long route through the entire newly equipped line section. However, this would significantly and disproportionately affect the other train operation.

The essential advantage of the invention lies in a greater working capacity of the line section under the circumstances specified above.

Furthermore, no further signals are required on the sidetracks since these, if present, are part of another train protection system. According to the invention, an operating method is proposed here which prompts the train driver of the unequipped train to stop immediately in the event of such a diverging motion. Such rules governing train operation are found in the American model, for example. The solution is advantageous if the sidetrack is normally traversed only rarely. During the traversal intervals, the sidetrack can then be used as a safety section in the sense that the train which is not fitted with the protection system can be rerouted onto this sidetrack in order to prevent an accident.

The invention is intended to ensure that the protecting switch, when used as such, is able to allow continuation of a run. The switch must already be indicated as released at this time point. A track clear indication is then no longer required at this time point. The release indication of the switch is advantageously carried out by the installed train protection system, which can indicate a track as clear and/or a switch as released solely on the basis of the positions of the trains. In other words, as long as no unequipped train traverses a line section, a track clear indication or a switch release indication is performed system-internally on the basis of the known train positions, e.g. by means of a CBTC (communication-based train control) train protection system.

The advantage of the invention is that the normal train operation, equipped with the new train protection system, can continue since it is protected by the protecting switch leading to the sidetrack. This normal train operation relates to the line section which has not yet been traversed by the unequipped train. The protecting switch in this case must be released from its protecting function and become part of the trackway in a timely manner, depending on the preceding normal train operation. The subsequent protection is then provided by a switch lying further ahead. This switch must be indicated as released at this time point at the latest and specifically, as described above, solely by analyzing the known train positions of the normal train operation using the new train protection system.

The invention therefore allows the passage of an individual unequipped train through a line section which is equipped with the inventive train protection system. The train protection system is able to indicate switches as released and line sections as clear on the basis of train positions of the equipped trains, wherein neither signals nor lineside track clear indication equipment is installed. In this way, the normal train operation can continue on the line section not yet traversed by the unequipped train. The working capacity of the line is thereby increased and the stated objective is therefore inventively achieved.

According to an embodiment of the invention, provision is made for a plurality of switches to be provided in the line section and for a block section extending from one switch to the following switch to be authorized, wherein:

a) the following switch is set for the purpose of following-move protection and b) the following switch is reset again before the passage of the train that is not equipped with the train protection system.

As explained above, the line section can already be divided into two partial sections (also referred to as block sections) if a single switch is provided in this line section. If however a plurality of switches are available in the line section, these leading in each case to unused sidetracks, it is advantageously possible to provide even more and therefore also shorter block sections in the line section. As it passes through the line section, the train that is not equipped with the train protection system can then be effectively forwarded from block section to block section, wherein the block sections that lie ahead of the respective activated protecting switch in each case can still be traversed by trains that are equipped with the train protection system. At the same time, block sections through which the train that is not equipped with the train protection system has already passed are authorized again. The authorization takes place on the precondition that these block sections are actually free again. This can be achieved by using axle counters, for example. A further possibility is the performance of track clearing runs (further details below).

According to an embodiment of the invention, in the event that a train that is not equipped with the train protection system is to enter the line section, provision is made for the switch to be set for the purpose of following-move protection only if a) a train is situated in the block section which comes after the switch, or b) a train enters the block section which comes after the switch during the time in which the train that is not equipped with the train protection system is expected to be situated in the block section extending as far as the switch.

This embodiment of the invention takes advantage of the insight that operation of the respective switch as a protecting switch is only ever necessary if an accident could actually occur on the block section lying ahead. This is only the case if either a train is currently situated in the block section lying ahead, as soon as the train that is not equipped with the train protection system enters the following block section (following is meant in the sense that the following block section viewed in the direction of travel lies directly behind the block section lying ahead), or if a train that is equipped with the train protection system will shortly be entering the block section lying ahead. This can be caused e.g. by a switch setting which will result in a train that is equipped with the train protection system traversing a block section lying ahead of the respective line section. In the case of the latter variant, it is necessary to calculate the time period for which the train that is not equipped with the train protection system is situated in the following block section. This is readily possible with knowledge of the speed of this train and the length of the block section lying ahead.

The advantage of this embodiment of the invention is that the operation of switches as protecting switches only occurs when this is actually necessary on the line for reasons of safety. The inventive method can therefore be performed with even greater efficiency. For example, it is possible to guide the train that is not equipped with the train protection system through a block section which cannot be protected by the switch lying ahead as a protecting switch because the track lying beyond it is currently occupied, for example. However, if it is known that the block section lying ahead will remain free for the time being, the operation of the switch lying ahead as a protecting switch is not necessary, and therefore the train that is not equipped with the train protection system can nonetheless traverse the current block section.

According to an embodiment of the invention, provision is made for the block section to be authorized for operation of the train protection system again as soon as the train that is not equipped with the train protection system has left the line section again.

As a result of some of the block sections that have been passed being already authorized again while the train that is not equipped with the train protection system is passing through the line section, operation with trains that are fitted with a train protection system is possible again in the block section that has already been passed. The efficiency of the inventive method can advantageously be further increased thereby. As mentioned above, for reasons of safety, this is conditional upon it being possible already to indicate as clear those block sections already passed.

According to an embodiment of the invention, provision is made for the block section to be authorized for operation of the train protection system again only if a track clearing run has first been performed on the respective block section by a train that is suitable for operation with the train protection system.

For reasons of safety, a clear indication must take place for a block section which is no longer traversed by a train that is not equipped with the train protection system (unequipped train). This can be achieved by the first train after the use of the line by unequipped trains being an equipped and driver-occupied train, for example, which performs a so-called track clearing run. It is thus ensured that this train has already cleared the switch region and is also already beyond the switch used as a protecting switch when the switch is next set. After this track clearing run, it is confirmed that the unequipped train operation is no longer in force and that the line can therefore be operated exclusively using equipped trains again (i.e. trains which are equipped with the train protection system). Such a track clearing run can be carried out e.g. in accordance with the normal American operating rules, i.e. running on indication. This means that an equipped driver-occupied train can safely follow the unequipped train when the position is unknown, the train completeness is not indicated and no track clear indication equipment is present as part of the lineside train protection apparatus.

Therefore the unequipped train operation in particular continues in accordance with these "old" operating rules, which are largely based on verbal train announcements. In order to allow running which corresponds to the "old" operating rules, for the purpose of operating a train that is not equipped with the train protection system, provision is made according to an embodiment of the invention for using a communication interface between a train driver of the train that is not equipped with the train protection system and a lineside train protection arrangement.

These operating rules also apply to the timely throwing of the protecting switch. It is thus ensured that the unequipped train does not traverse the protecting switch when the switch is receiving the throwing request. According to a further embodiment of the invention, a technical solution containing an activation detector is naturally also possible. The activation detector advantageously prevents the protecting switch from being set while an unequipped train is passing over it. In comparison with the signaling equipment that is economized according to the invention, the costs associated with the operation of an activation detector are considerably lower, and therefore greater cost-effectiveness can advantageously be achieved.

According to an embodiment of the invention, for the purpose of operating the train that is not equipped with the train protection system, provision is made for line-based detection to take place, in particular by means of axle counters.

These embodiment variants of the invention allow train operation of an unequipped train using the lineside train protection arrangement, and allow a block section that has been left by this train to be authorized by counting the axles of the unequipped train. It is thereby possible to determine whether the train has lost a car and the respective block section has consequently not been cleared. Otherwise, the block section can be authorized after traversal by the unequipped train is complete. This principle of the authorizing of block sections can be preferentially applied in the European area, where existing axle counters of the rail network can be used.

According to an embodiment of the invention, provision is made for a first lineside train protection arrangement, which controls the line section, to communicate with a second lineside train protection arrangement, which controls a further line section coming after the switch.

The communication between train protection arrangements (preferably interlocking cabins) advantageously allows subsequent line sections, which are not controlled by the respective lineside train protection arrangement guiding the unequipped train, to also be used for operation of the switch as a protecting switch. The train protection arrangement that is guiding the unequipped train receives an authorization indication from the train protection arrangement which controls the relevant line section for the protecting switch, wherein this authorization indication represents a condition for the respective switch to actually be deployed as a protecting switch. If this clear indication is not forthcoming, it cannot be guaranteed that, in the event of a diversion onto the further line section, the unequipped train will collide with a train that is situated there.

A line authorization is therefore not granted in the latter case. The communication between a plurality of train protection arrangements therefore advantageously allows further line sections coming after switches to be available in order to set up block sections on the line section. According to an embodiment of the invention, provision is therefore made for the first lineside train protection arrangement to set the switch only if an authorization for the further line section is granted by the second lineside train protection arrangement.

Alternatively, the cited object is also inventively achieved by the subject matter of the claim (track section) as cited in the introduction, in that in the event that a train that is not equipped with the train protection system enters the line section, a block section thereof which extends as far as the switch can be authorized, wherein:

a) the switch can be set for the purpose of following-move protection; and b) the switch can be reset again before the passage of the train that is not equipped with the train protection system.

The track-bound line section according to the invention is therefore advantageously suitable for realizing the method described above. The advantages cited in connection with the inventive method are therefore likewise achieved in the operation of the line section. In particular, the inventive line section therefore has the advantage that the construction of such a line section or the conversion of such a line section for rail vehicles that are fitted with the train protection system requires less investment, even if the traversal of unequipped trains must still be guaranteed. The operation of the line section can also be realized more cost-effectively, since a lineside train protection arrangement that is retained for this line section is more cost-effective to operate and maintain, and in particular operates largely without signals.

According to an embodiment of the invention, the line section can be controlled by a lineside train protection arrangement which allows the switch to be set in accordance with the conditions stated above.

The lineside train protection arrangement can therefore advantageously be used both to control and prepare the block sections that are predefined by the switches, and to assist an unequipped train through the line section while at the same time ensuring the safe train operation of equipped trains in the block sections which are not currently being traversed.

According to an embodiment of the invention, no light signals are provided at the at least one switch. As explained above, in particular the economizing of light signals on the line section results in a significant increase in the cost-effectiveness with regard to the setting up and operation of the relevant line section. This is due to the comparatively high maintenance expense of light signals, since the bulbs have to be replaced regularly, for example.

According to an embodiment of the invention, provision is made for the track-bound line section to have a light signal at the beginning only, as viewed in the direction of travel. The provision of a light signal at the beginning of the line section represents a comparatively modest additional expense in terms of the maintenance expense. However, the safety level of the operation of the relevant line section can be significantly increased thereby. At the beginning of the line section, the signal can advantageously be used to allow the initial entry of an unequipped train into the line section. The precondition for this is that the unequipped train can traverse the whole line section, in order that the train can leave the line section again within an acceptable time period.

If only the first block section of the line section is currently traversable, for example, traversal of the whole line section by the unequipped train is pointless even though in terms of safety the traversal of the first block section does not necessarily have to be prohibited. If the second block section cannot be traversed, however, the unequipped train would have to wait on the line section and would block at least the first block section for an extended time. It is therefore advantageous, for example, to grant an authorization for traversal of the line section by an unequipped train only if it is anticipated that the individual block sections of the line section will be successively traversable within an acceptable time period. Acceptable can mean, for example, that the train schedule of equipped trains on this line section is not disrupted by the total travel time of the unequipped train on the line section.

Further details of the invention are described below with reference to the drawing. Identical or corresponding drawing elements are denoted in each case by the same reference signs and are only explained more than once if there are differences between the individual figures.

Other features which are considered as characteristic for the invention are set forth in the appended claims.

Although the invention is illustrated and described herein as embodied in a line section for mixed operation with and without a train protection system, and an operating method, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
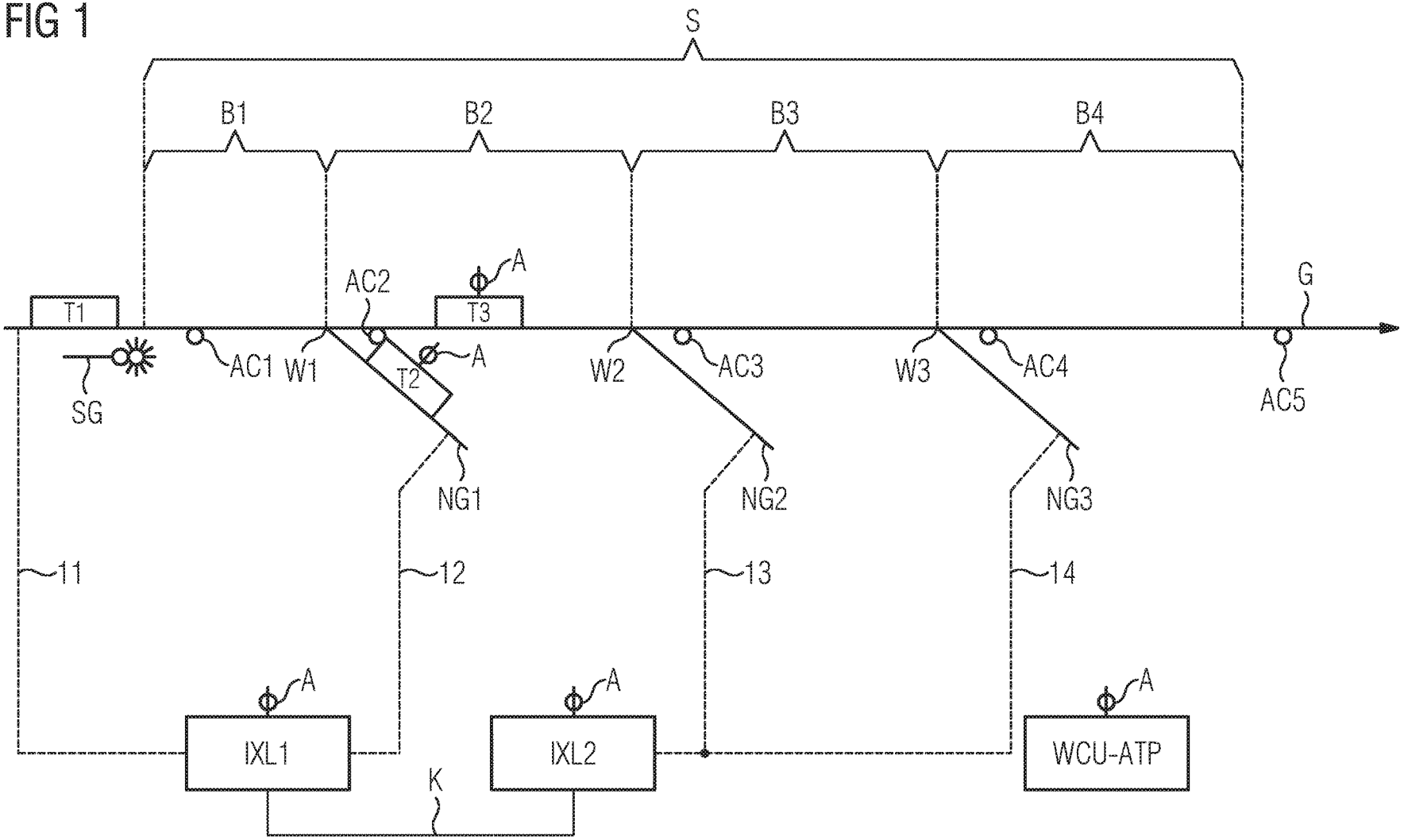
FIGS. 1 to 4 are schematic block diagrams showing an exemplary embodiment of a track-bound line section according to the invention.

Referring now to the figures of the drawings in detail and first, particularly to FIG. 1 thereof, there is shown a line section S which forms part of a track G. The track G provides a line for various trains T1, T2, T3. In addition, a plurality of sidetracks NG1, NG2, NG3 diverge from the track G. The sidetracks are set by switches W1, W2, W3. The switches W1, W2, W3 also serve to divide the line section S into a plurality of block sections B1, B2, B3, B4, the switch W1 lying between the block sections B1 and B2, the switch W2 between the block sections B2 and B3, and the switch W3 between the block sections B3 and B4.

The line section S is configured such that it can be traversed both by trains T1 that are not fitted with a train protection system WCU-ATP (unequipped trains or unfitted trains) and by trains T2, T3 that are fitted with the train protection system WCU-ATP (equipped or fitted trains). The fitted trains have antennas A which are part of the train protection system WCU-ATP.

The cited train protection system can be, for example, a system which is also referred to commercially as CBTC or Train Guard MT. This system is based on the so-called tracking of all fitted trains, i.e. the momentary position of these trains is known at all times. Furthermore, a required braking distance for these trains is taken into account, and defines a safety clearance in relation to other fitted trains. The line length required by the train, based on its dimensions and the braking distance that must be taken into account, is also referred to as a moving block. The application of moving blocks ensures that no lineside track clear indications are required if only equipped trains are moving in the line section S. The standard according to which the train protection system WCU-ATP works is referred to as CBTC.

It can be seen in FIG. 1 that the unequipped train T1 is situated on the track G shortly before the beginning of the line section S. A light signal SG is currently set to "red", i.e. indicating that the unequipped train T1 is prohibited from entering the line section S. This is because a passage through the line section S must be possible in a manner which takes the operation of the equipped trains T2 and T3 into account. This is currently not the case, as explained in greater detail below.

Conventional interlocking technology is required in order to safely assist the unequipped train T1, which is not visible to the train protection system WCU-ATP. This should nonetheless be effected as far as possible without additional light signals on the line section S. However, since the position of the equipped trains T2 and T3 is known at all times, the unequipped train T1 can be guided blind, so to speak, through the line section S, wherein this movement is guaranteed by lineside train protection arrangements in the form of interlocking cabins IXL1 and IXL2. These interlocking cabins utilize the possibilities provided by the infrastructure of the line section S and are therefore connected to the line network as indicated by the dashed connection lines 11, 12, 13 14. In the example according to FIG. 1, the track G and the sidetrack NG1 are controlled by the interlocking cabin IXL1 and the two sidetracks NG2 and NG3 are controlled by the interlocking cabin IXL2. The cited interlocking cabins are additionally interconnected via a communication connection K, such that all sidetracks NG1, NG2, NG3 can be used as buffer zones for the unequipped train T1 even though they are subordinate to different interlocking cabins.

The reason that the unequipped train T1 cannot enter the line section S is that following-move protection must be ensured in relation to the equipped train T3. According to the invention, the first block section B1 is actually free, but the following-move protection must be ensured via the switch W1 by setting this to the sidetrack NG1 in order to prevent a collision with the equipped train T3 under any circumstances. However, this is not currently possible because the sidetrack NG1 is traversed by the equipped train T2. Therefore the unequipped train T1 must wait until the light signal SG permits entry into the line section S.

In order to allow the interlocking cabins IXL1, IXL2 to evaluate the train positions of the equipped trains T2, T3, these are equipped with antennas A and therefore communication with the train protection system WCU-ATP is possible. In order to avoid any misunderstanding, it should be noted that unequipped trains (e.g. T1) are obviously also equipped with various antennas. However, only those antennas A required for the communication in the context of the train protection using the train protection system WCU-ATP are illustrated in FIG. 1. The equipped trains can therefore also be identified in FIG. 1 by the antennas A.

Also shown in FIG. 1 is the switch setting of the switches W1, W2, W3. Since none of these switches is set in FIG. 1, the rail route currently runs along the track G, and an arrowhead is therefore indicated at the end of the line section S. As described in the following figures, the predefined route changes as a result of setting the switches W1, W2, W, such that the arrowhead is extended in each case at the sidetrack which currently predefines the rail route for the unequipped train T1. The aim is naturally for the unequipped train T1 to pass through to the end of the line section S completely, and not diverge onto a sidetrack.

Figure 2:
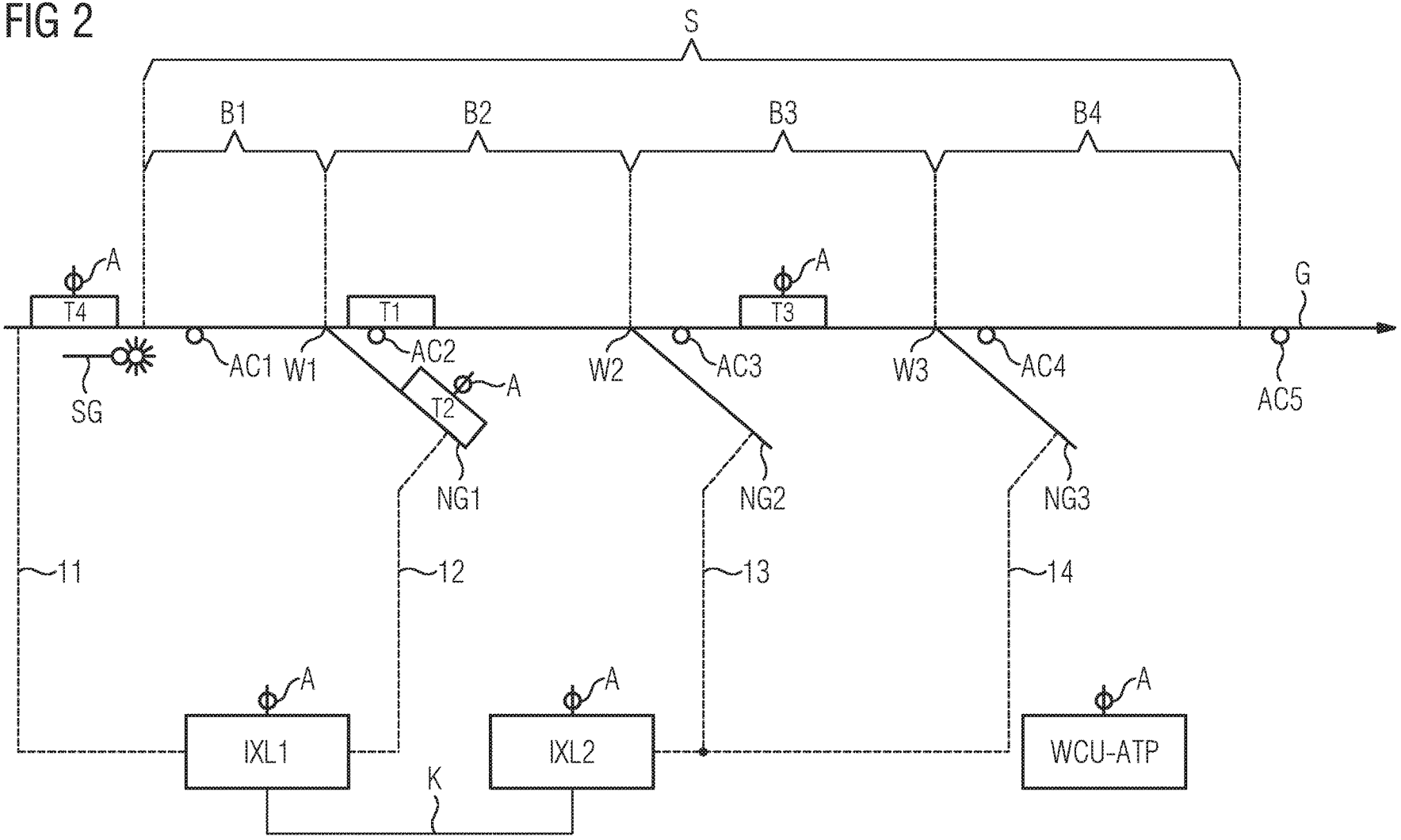

FIG. 2 shows the scenario as per FIG. 1 at a later time point. The trains T2 and T3 (both equipped) have moved on. Specifically, the train T2 is still on the sidetrack NG1 and therefore the switch W1 could not be set as a protecting switch. However, the equipped train T3 has moved from the block section B2 into the block section B3 and therefore the block section B2 is free. Furthermore, the equipped train T3 is now situated beyond the switch W2, and therefore this can be set as a protecting switch and reroute the unequipped train T1 onto the sidetrack NG2 (indicated by the arrowhead). Consequently, the unequipped train can traverse both the block section B1 and the block section B2. The light signal SG therefore signals the possible entry of the train T1, which is already situated in the block section B2. Finally, the light signal must prevent the entry of further trains into the line section S, since the position of the train T1 is not precisely known. This also applies to an equipped train T4, which awaits entry into the line section S.

FIG. 2 also shows axle counters AC1, AC2, AC3, AC4, which are likewise part of the lineside train protection arrangement. These are used for registration of the unequipped train T1, one of the axle counters being placed in each of the block sections B1, B2, B3, B4. According to FIG. 2, the unequipped train T1 is currently passing over the axle counter AC2 at the beginning of the second block section B2, wherein the complete passage of the train is registered by the interlocking cabin IXL1. When the train has completely (i.e. including all cars) passed over the axle counter AC2, it is then already possible to authorize the block B1 for a track clearing run by the equipped train T4. In order to guarantee a minimum distance between the trains T1 and T4, the entry of the train T4 into the block sections B2, B3, B4 in each case can always be made dependent on whether the unequipped train T3 has arrived completely in the subsequent block section. It should be noted here that the method can also be performed without axle counters, in that verbal instructions and messages from the train T1 in relation to its position can be exchanged with the interlocking cabin IXL1.

Figure 3:
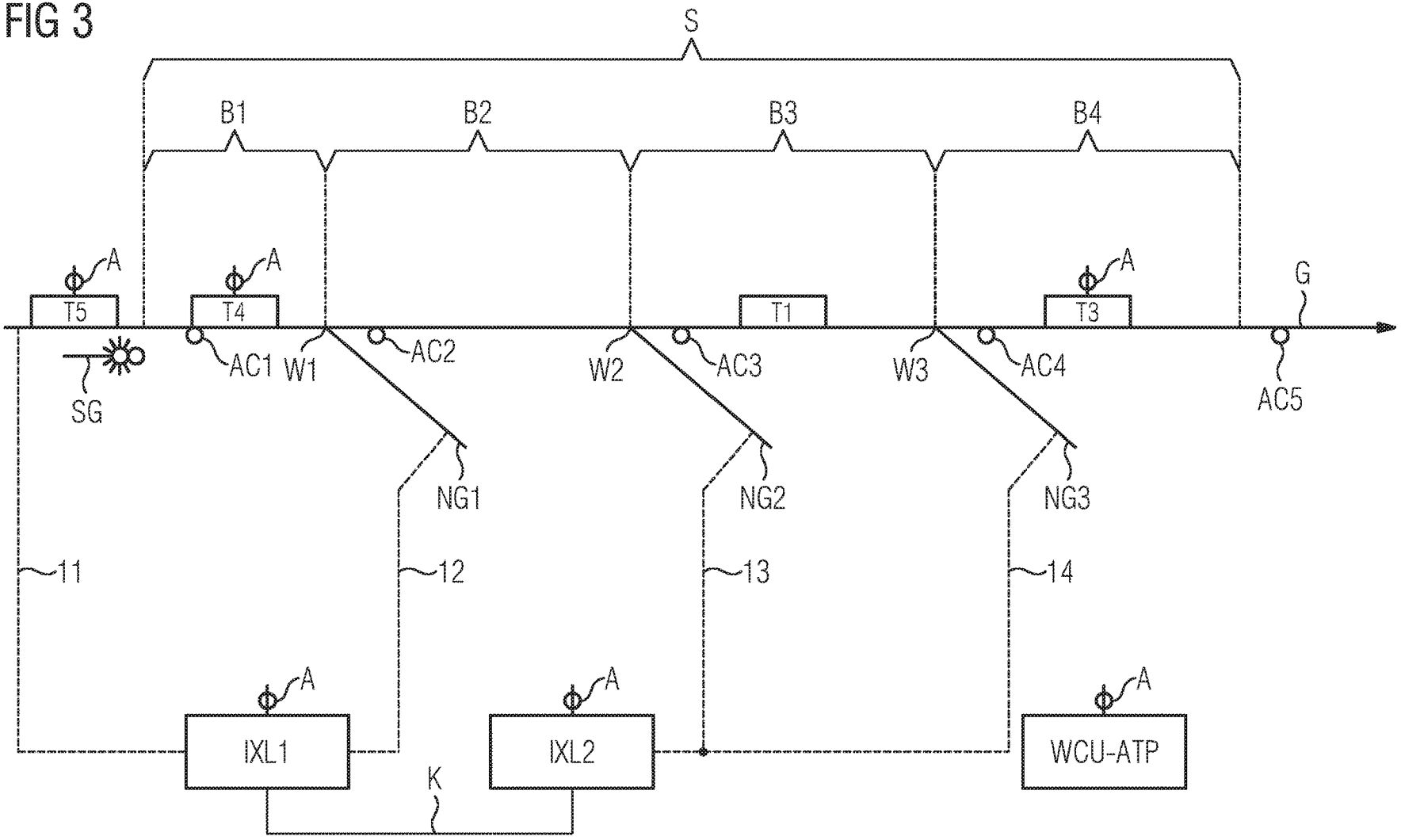

FIG. 3 illustrates a later time point in the passage of the unequipped train T1. It can be seen that the equipped train T3 is now in the fourth block section B4, followed by the unequipped train T1 in the third block section B3. Before the train T1 moved into the block section B3, the switch W2 was thrown back onto the track G, since the train T1 is intended ultimately to pass through the line section S. At the time point at which the switch W2 was set, the equipped train T3 was already in the block section B4, and therefore any danger of a collision in the block section B3 was no longer present. The switch W3 has been set instead of the switch W2, however, such that the unequipped train T1 would be guided onto the sidetrack NG3 in order to ensure following-move protection for the equipped train T3 (the arrowhead is therefore at NG3 in this case).

At the same time, a track clearing run has started in the block section B1 with the equipped train T4. Although this train is equipped, it has a vehicle driver who maintains visual contact with the line section S ahead and would detect any obstacles situated on the track as a result of the passage of the unequipped train T1. For this purpose, the vehicle driver of the train T4 is in voice contact with the interlocking cabin IXL1 via a telephone connection. In addition to this, an equipped train T5 is situated shortly before the entry into the line section S. The light signal SG signals to this train that entry into the block B1 is possible (i.e. set to "green"). This is possible because that part of the line section S which lies behind the equipped train T4 is already cleared and is therefore authorized for automatic train operation. If braking of the train T4 is required due to obstacles, a collision between the trains T4 and T5 is ruled out by virtue of the train protection system WCU-ATP.

Figure 4:
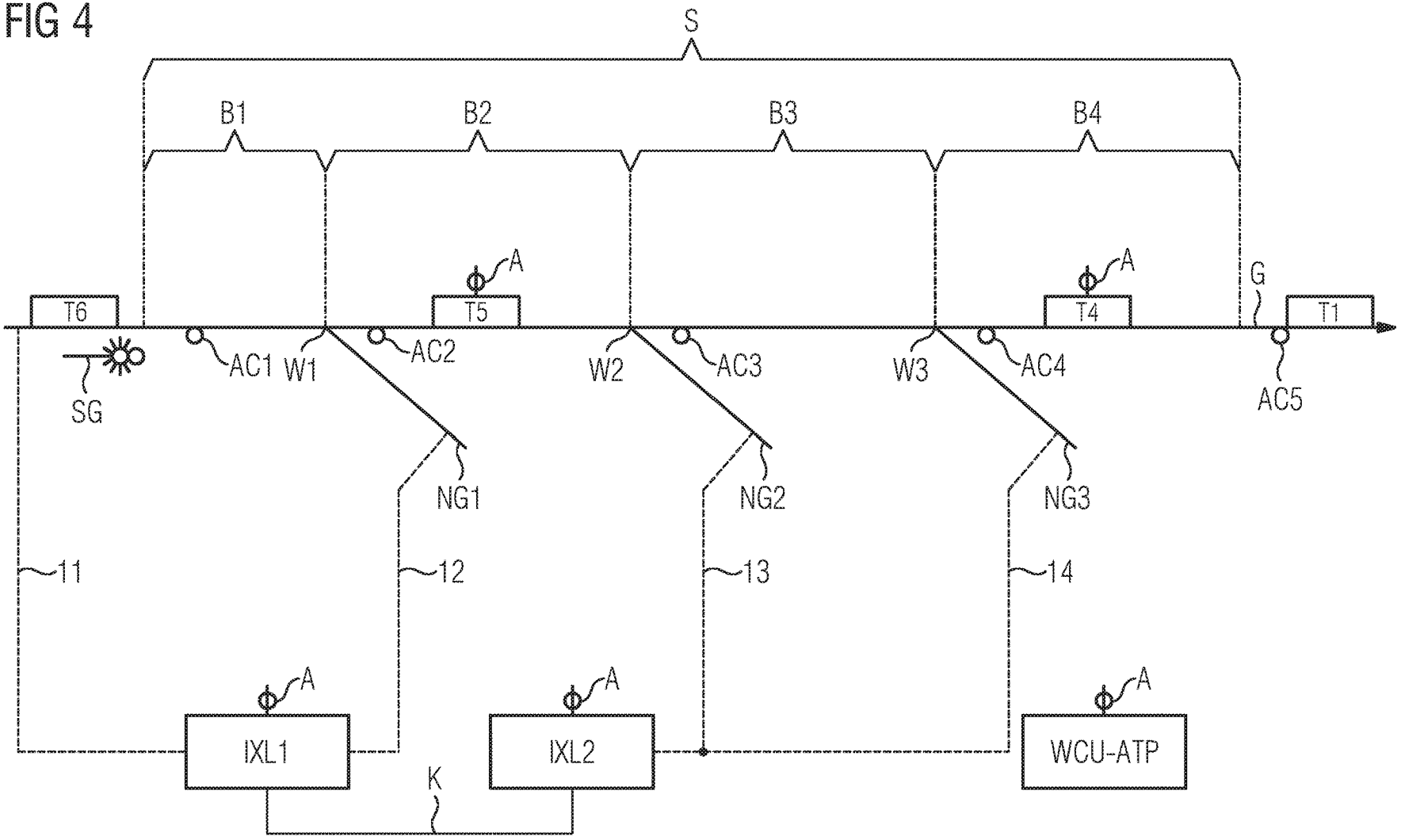

FIG. 4 illustrates the situation after the passage of the unequipped train T1 is complete. The train T1 is now on the other side of the line section S, i.e. it has slipped in and along the line section S between the equipped trains T2, T3 and the equipped trains T4, T5. Limited rail traffic was possible for the cited equipped trains in this case, i.e. the line section S was never completely prohibited, but only on a block section by block section basis in each case. In other words, the blocks B3, B4 could initially still be traversed at the time of entry of the unequipped train T1 (cf. FIG. 1), and the blocks B1 and B2 could be traversed again already before the exit of the unequipped train T1 (cf. FIG. 3).

It can also be seen in FIG. 4 that the unequipped train T1 has also passed the axle counter AC5, and therefore it is possible to calculate whether the unequipped train T1 when exiting the line section S had all its cars. In addition to this, the equipped train T5 has already arrived in the block section B2, and therefore the light signal SG for a new unequipped train T6 shows "green". The train T6 can enter the block section B1, since both this block section and the sidetrack NG1 are free and therefore the switch W1 can be set as a protecting switch.

FIGS. 1 to 4 show that it is possible to determine the completeness of the train T1 on a block section by block section basis in each case using the axle counters AC1, AC2, AC3, AC4, AC5. In addition to this, a track clearing run was performed by the equipped train T4. This method as described by the exemplary embodiment is particularly safe.

However, it is also possible to perform a track clearing run by means of the equipped train T4 in the manner described above, without the use of axle counters. Corresponding precautionary measures must be taken in this case, e.g. by suitable selection of the train speed during the track clearing run. This method is common in the American model, for example.

A further possibility is to dispense with the provision of a train for a track clearing run. Instead, an authorization indication is performed block section by block section after the axle counters AC2, AC3, AC4, AC5 are passed in each case. The result of the axle counter AC1 when the unequipped train T1 enters the block section B1 is used as a reference value.

The two adapted methods cited above are less safe due to a lack of redundancy, and therefore the choice of authorization method for the line section S depends on the respective safety specifications.

The following is a summary list of reference numerals and the corresponding structure used in the above description of the invention:

| | |
|---|---|
| A | Antennas |
| AC1, AC2, AC3, AC4, AC5 | Axle counter |
| B1, B2, B3, B4 | Block section |
| G | Track |
| IXL1 | First interlocking cabin |
| IXL2 | Second interlocking cabin |
| K | Communication connection |
| NG1, NG2, NG3 | Sidetrack |
| S | Line section |
| SG | Light signal |
| T1 | Train not using CBTC |
| T2, T3, T4 | Train using CBTC |
| W1, W2, W3 | Switch |
| 11, 12, 13, 14 | Connection line |

The invention claimed is:

1. A method for a mixed operation of a track-bound line section, which comprises the steps of:

traversing the track-bound line section with trains equipped with a train protection system, and by trains not equipped with the train protection system; and fitting the track-bound line section with at least one switch, in an event that a train that is not equipped with the train protection system is to enter the track-bound line section, a block section of the track-bound line section which extends as far as the switch is authorized, wherein the switch is set for a purpose of following-move protection and the switch is reset again before a passage of the train that is not equipped with the train protection system.

2. The method according to claim 1, which further comprises providing a plurality of switches in the track-bound line section and a block section extending from one switch to a following switch is authorized, wherein the following switch is set for a purpose of following-move protection and the following switch is reset again before a passage of the train that is not equipped with the train protection system.

3. The method according to claim 1, wherein in an event that the train that is not equipped with the train protection system is to enter the track-bound line section, the switch is set for a purpose of following-move protection only if the train is situated in the block section which comes after the switch or a train enters the block section which comes after the switch during a time in which the train that is not equipped with the train protection system is expected to be situated in the block section extending as far as the switch.

4. The method according to claim 1, wherein the block section is authorized for operation of the train protection system again as soon as the train that is not equipped with the train protection system has left the track-bound line section again.

5. The method according to claim 4, wherein the block section is authorized for operation of the train protection system again only if a track clearing run has first been performed on a respective track section by a train that is suitable for operation with the train protection system.

6. The method according to claim 1, wherein for a purpose of operating the train that is not equipped with the train protection system, a communication interface between a train driver of the train that is not equipped with the train protection system and a lineside train protection configuration is used.

7. The method according to claim 1, wherein for a purpose of operating the train that is not equipped with the train protection system, line-based detection is performed.

8. The method according to claim 1, wherein a first lineside train protection configuration, which controls the track-bound line section, communicates with a second lineside train protection configuration, which controls a further line section coming after the switch.

9. The method according to claim 8, wherein the first lineside train protection configuration sets the switch only if an authorization of the further line section is granted by the second lineside train protection configuration.

10. The method according to claim 1, wherein for a purpose of operating the train that is not equipped with the train protection system, line-based detection is performed by means of axle counters.

11. The method according to claim 1, wherein the train protection system is a communication-based train controller (CBTC).

12. A track-bound line section to be traversed by trains, the track-bound line section comprising:

at least one switch, in an event that a train about to traverse the track bound line section and is not equipped with a train protection system enters the track-bound line section, a block section of the track-bound line section which extends as far as said at least one switch is authorized, wherein said at least one switch can be set for a purpose of following-move protection and said at least one switch can be reset again before a passage of the train that is not equipped with the train protection system.

13. The track-bound line section according to claim 12, further comprising a lineside train protection configuration which controls the track-bound line section and allows said at least one switch to be set in accordance with conditions stated in claim 11.

14. The track-bound line section according to claim 12, wherein no light signals are provided at said at least one switch.

15. The track-bound line section according to claim 12, further comprising a light signal disposed only at a beginning of the track-bound line section, as viewed in a direction of travel.

* * * * *